US011523491B2

(12) United States Patent
Raymond et al.

(10) Patent No.: US 11,523,491 B2
(45) Date of Patent: Dec. 6, 2022

(54) METHODS OF MAKING AND ASSEMBLING TOGETHER COMPONENTS OF PLASMA TORCH ELECTRODE

(71) Applicant: The ESAB Group Inc., Florence, SC (US)

(72) Inventors: Andrew J. Raymond, Lebanon, NH (US); Michael Nadler, Wilmot, NH (US)

(73) Assignee: THE ESAB GROUP INC., North Bethesda, MD (US)

( * ) Notice: Subject to any disclaimer, the term of this patent is extended or adjusted under 35 U.S.C. 154(b) by 304 days.

(21) Appl. No.: 16/702,876

(22) Filed: Dec. 4, 2019

(65) Prior Publication Data

US 2021/0176853 A1 Jun. 10, 2021

(51) Int. Cl.
*H05H 1/34* (2006.01)

(52) U.S. Cl.
CPC ..... *H05H 1/34* (2013.01); *H05H 1/3478* (2021.05)

(58) Field of Classification Search
CPC ..... H05H 1/34; H05H 1/3478; H05H 1/3442; H05H 1/3452; H05H 1/3431; H05H 1/3436; H05H 1/3447; H05H 1/38; B23K 35/402; B23K 10/00; B23K 10/10; B23K 35/10
USPC ..... 219/121.52, 121.27, 121.48, 121.53, 219/121.59
See application file for complete search history.

(56) References Cited

U.S. PATENT DOCUMENTS

| | | | | |
|---|---|---|---|---|
| 3,498,094 | A | 3/1970 | Simon | |
| 4,001,461 | A | 1/1977 | Bykhovsky | |
| 4,396,820 | A | 8/1983 | Puschner | |
| 5,779,825 | A | 7/1998 | Moon | |
| 6,007,646 | A | 12/1999 | Moon | |
| 6,483,070 | B1 * | 11/2002 | Diehl | H05H 1/34 219/121.52 |
| 6,528,753 | B2 * | 3/2003 | McBennett | B23K 35/402 219/121.52 |
| 6,563,075 | B1 | 5/2003 | Severance, Jr. et al. | |
| 7,887,712 | B2 * | 2/2011 | Boyle | B23K 26/1462 216/65 |
| 8,759,709 | B2 | 6/2014 | Mather et al. | |
| 8,993,917 | B2 | 3/2015 | Shiino et al. | |
| 9,327,366 | B2 | 5/2016 | Karogal | |
| 9,516,738 | B2 | 12/2016 | Wittmann et al. | |
| 2004/0105775 | A1 | 6/2004 | Prucher | |
| 2006/0207984 | A1 | 9/2006 | Karogal | |
| 2008/0178734 | A1 | 7/2008 | Butler et al. | |

FOREIGN PATENT DOCUMENTS

GB 1157972 A 7/1969

* cited by examiner

*Primary Examiner* — Geoffrey S Evans
(74) *Attorney, Agent, or Firm* — Edell, Shapiro & Finnan, LLC

(57) ABSTRACT

A method of making and assembling together components of a plasma torch electrode inside an oxygen-free environment. According to one implementation the method includes machining an outer surface of an emitter to produce an oxide free outer surface and machining an opening in a distal end of a main body of the electrode, the opening being bound by an oxide-free inner surface of the main body after the machining. In the oxygen-free environment, the emitter is then secured inside the opening of the main body such that the oxide-free outer surface of the emitter is secured to the oxide-free inner surface of the main body.

19 Claims, 16 Drawing Sheets

METHODS OF MAKING AND ASSEMBLING TOGETHER COMPONENTS OF PLASMA TORCH ELECTRODE

TECHNICAL FIELD

The present disclosure relates to methods of making and assembling together components of a plasma torch electrode.

BACKGROUND

Current processes of making and assembling together the components of a plasma torch electrode result in the existence of oxide layers between them when they are assembled. The components at least include a main body and an emitter residing inside an opening at the distal end of the main body. When the components are assembled together, they are electrically and thermally connected. When the plasma torch is in use, the main body of the electrode is electrically coupled to a power source and transmits to the emitter current flow to produce a plasma arc that attaches to the workpiece during a cutting operation. The main body is typically made of copper or a copper alloy and the emitter is typically made from hafnium, tungsten, zirconium and their alloys. Components made of these materials are subject to the formation of oxide layers on their outer surfaces. The existence of the oxide layers on one or both of the main body and emitter adversely interjects electrical resistance between the parts that negatively impacts the efficiency of the plasma cutting operation. The oxide layers also impede heat transfer between the emitter and main body that negatively impacts the removal of heat from the emitter. Each of these issues can result in a shortened lifespan of the components, causing an increase in operating costs.

In some instances the emitter is held inside an emitter holder that is in turn held inside an opening of the main body. The emitter holder is typically made of silver and is also subject to the formation of an oxide layer on its outer surfaces. The existence of the oxide layer has the same drawbacks as discussed above. Namely, it imposes electrical resistance between the parts and impedes heat transfer between them.

Existing methods to inhibit the formation of oxidation layers on the components of the electrode include coating the surfaces of the components with an oil-based compound during their manufacture to hinder exposing the surfaces to oxygen in the ambient (air) environment. There are several problems with this approach. First, prior to assembling the components they must undergo a cleaning process. Improper cleaning can lead to the existence of contaminates that can itself adversely affect the electrical and thermal bond between, for example, the main body and emitter. Secondly, even in the event the electrode and emissive element are properly cleaned, there exists a time interval after the cleaning process in which the parts are exposed to oxygen before they are mated together. Because oxidation at the surfaces of the electrode and emissive element occur substantially instantaneously, it is unavoidable for a certain amount of oxidation to occur at the surfaces of the parts. What is needed is a method of manufacturing and assembling together the parts of an electrode that solves at least some of the aforestated problems.

SUMMARY

The present disclosure is directed towards methods of making and assembling together components of a plasma torch electrode. According to one implementation the components include a main body and an emitter that are made of different electrically conductive materials. According to some implementations the emitter is made of one of hafnium, zirconium, tungsten and their alloys. According to some implementations the main body of the electrode is made of copper or a copper allow. Components made of these materials are readily susceptible to the formation of oxide layers on their exposed surfaces. To overcome the problems associated with the existence of these oxide layers, at least the mating portions of the main body and emitter are both machined to remove the oxide layers while located in an oxygen-free environment. Thereafter, while remaining in the oxygen-free environment, the main body and emitter are assembled together so that their oxide-free mating portions are placed in intimate contact with one another to produce an electrical and thermal connection between the two.

According to one implementation an outer surface of the emitter is machined with the use of a cutting tool to remove any existing oxide layer (e.g. hafnium oxide) to produce an oxide-free outer surface. Any of a variety of material removing processes may be employed for this purpose, such as, for example, one or more milling processes, grinding processes, etc. Before, after or concurrently with machining the emitter, the main body is also machined (e.g. drilled) to produce in a distal end thereof an opening bound by an oxide-free inner surface of the main body. Thereafter, while remaining in the oxygen-free environment, the emitter is secured inside the opening of the main body such that the oxide-free outer surface of the emitter is secured to the oxide-free inner surface of the main body.

The electrode components may additionally include an emitter holder having an opening in which the emitter is retained. In such implementations, the emitter holder is in turn retained inside an opening in the distal end of the main body. The emitter holder is also made of a material (e.g. silver) that is electrically and thermally conductive, and like hafnium and copper, is also readily susceptible to oxidation when exposed to an environment containing oxygen. To overcome the problems associated with the existence of oxide layers on the mating portions of the main body, emitter holder and emitter, the mating portions of these components are machined to remove the oxide layers while located in an oxygen-free environment. Thereafter, while remaining in the oxygen-free environment, the main body and emitter holder are assembled together so that their oxide-free mating portions are placed in intimate contact with one another to produce an electrical and thermal connection between the two. Before, after or concurrently with the assembling of the main body and emitter holder, the emitter holder and emitter are also assembled together so that their oxide-free mating portions are placed in intimate contact with one another to produce an electrical and thermal connection between them.

According to one implementation an outer surface of the emitter and an outer surface of the emitter holder are machined with the use of one or more cutting tools to remove an oxide layer from each of the components to produce in each of the components an oxide-free outer surface. Any of a variety of milling or turning processes may be employed for this purpose. The main body and emitter holder are also machined (e.g. drilled or bored) to produce at each of their distal ends an opening that is respectively configured to mate with the emitter holder and the emitter. Each of the openings is bound by an oxide-free inner surface of the respective main body and emitter holder.

While remaining in the oxygen-free environment, the emitter holder is secured inside the opening of the main body such that the oxide-free outer surface of the emitter holder is in intimate contact with the oxide-free inner surface of the main body. Before, after or concurrently with securing together the main body and emitter holder, the emitter is secured inside the opening of the emitter holder such that the oxide-free outer surface of the emitter is in intimate contact with the oxide-free inner surface of the emitter body.

It is important to note that in electrodes comprising a main body, an emitter holder and an emitter that the removal of oxide layers may occur in a set of mating surfaces of the main body and emitter holder and/or a set of mating surfaces of the emitter holder and emitter.

In electrodes possessing a main body, an emitter holder and an emitter, the components may be fixed together by a method that includes securing together the emitter inside the emitter holder while at the same time securing together the emitter holder inside the main body. The securing together is accomplished by simultaneously applying a proximal directed force to the emitter and a distal directed force to the emitter holder to induce a bulging of the emitter inside the emitter holder to cause an external surface of the emitter to forcefully contact an internal surface of the emitter holder, and to induce a bulging of the emitter holder inside the distal end of the main body to cause an external surface of the emitter holder to forcefully contact an internal surface of the main body to produce a leak-tight seal and an electrical connection between the emitter holder and the main body. According to some implementations, the securing together is accomplished without soldering or fusing the emitter holder to the main body and without soldering or fusing the emitter to the emitter holder. That is, none of the materials of the electrode components combine with one another to form an alloy of the materials. Instead, the materials remain as they were prior to the electrode assembly process. Thus, when it is stated herein that the parts are secured together without "fusing", it is meant that the materials do not melt together or otherwise combine to form another type of material.

DETAILED DESCRIPTION

Various implementations of making and assembling together various parts of a plasma torch electrode are disclosed herein.

Figure 1A:
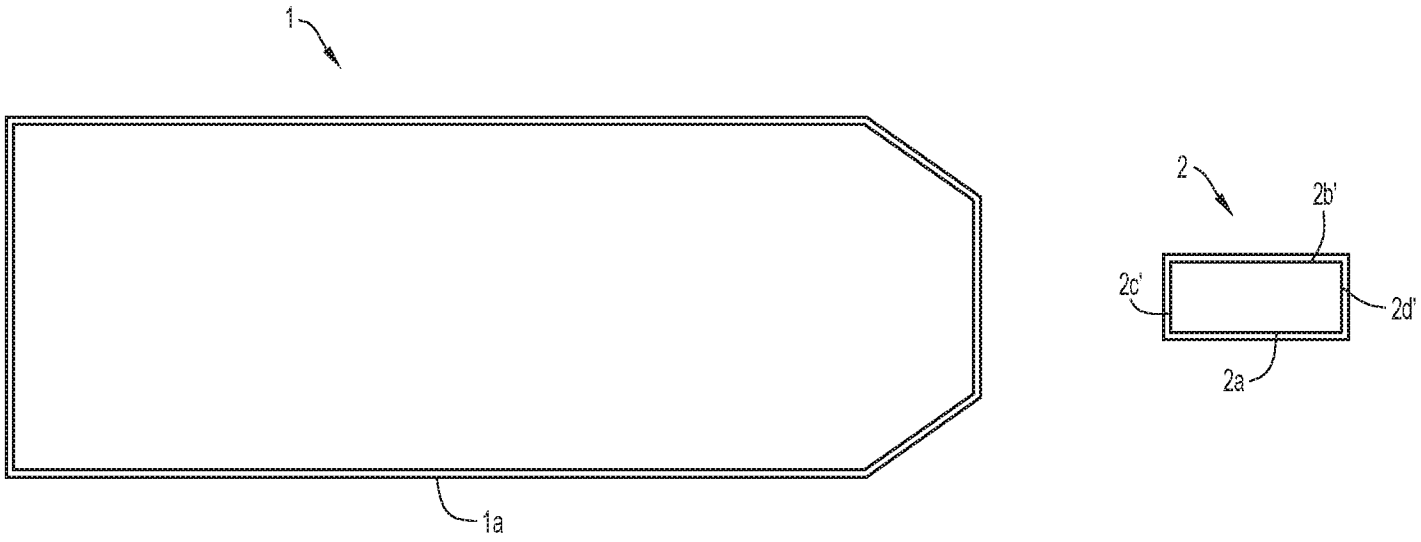
FIG. 1A is a cross-sectional side view of a main body and emitter of an electrode prior to the components being machined and assembled together.

FIGS. 1A-D illustrate a method of making and an assembling together a main body 1 and emitter 2 of a plasma torch electrode. FIG. 1A shows a side view of the main body 1 and emitter 2 prior to them be machined and assembled together, with each of the parts respectively possessing an oxide-layer 1*a* and 2*a* disposed about its perimeter. In the examples that follow, the main body 1 is disclosed to be made of copper and the emitter 2 is disclosed to be made of hafnium. It is appreciated that the main body 1 and emitter 2 may be made of any other materials that allow the parts to collectively function as a plasma torch electrode. The electrode may include parts other than the main body and emitter that contribute to its functionality. In addition, in the implementations of FIGS. 1A-D, each of the main body 1 and emitter 2 are shown having a cylindrical configuration. It is appreciated, however, that the main body 1 and emitter 2 may comprise non-cylindrical configurations.

Figure 1B:
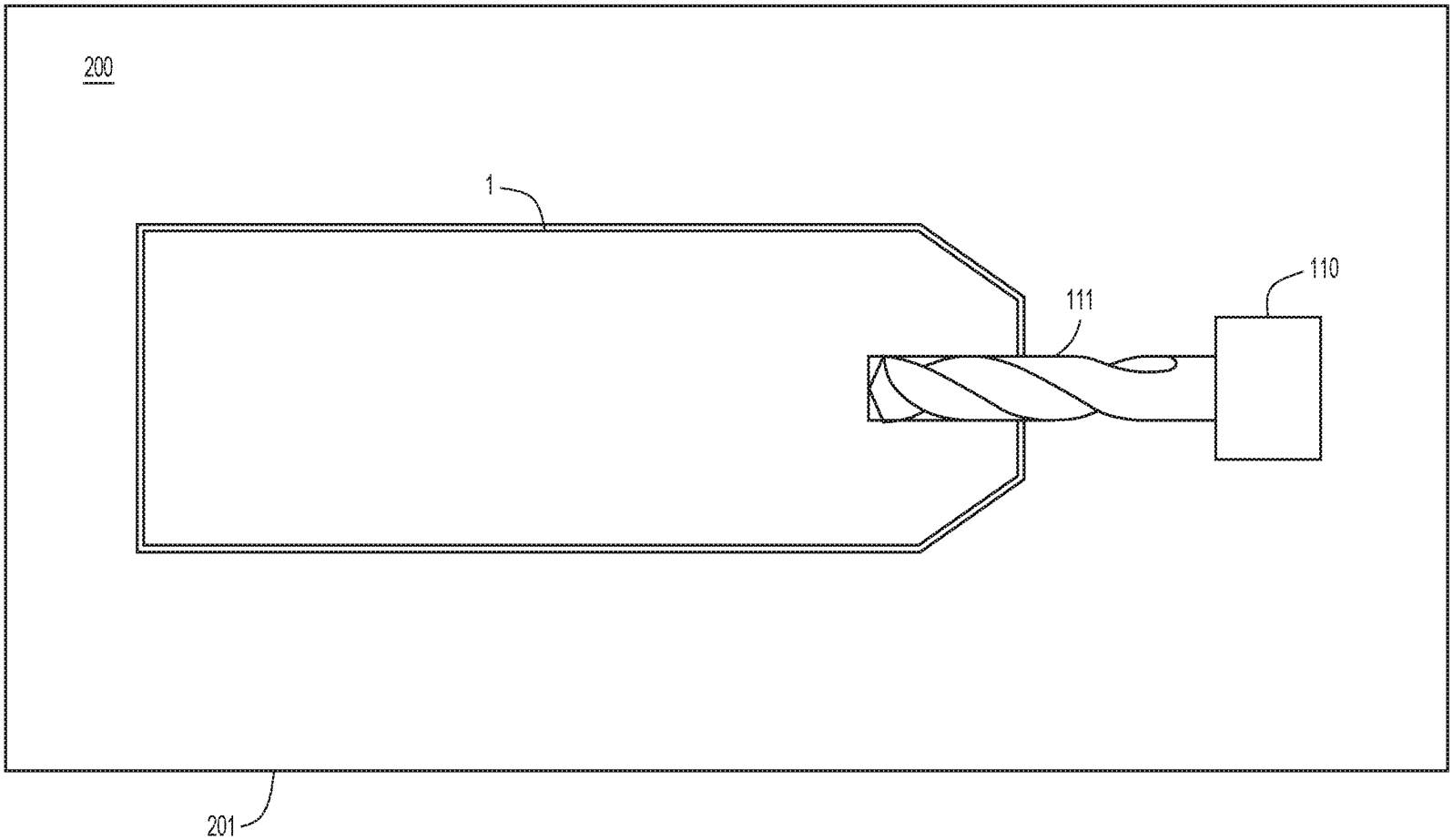
FIG. 1B shows a cross-sectional side view of the main body of FIG. 1A located in an oxygen-free environment with a cavity being formed in a distal end of the main body.

Turning again to FIG. 1A, the outer surfaces of the main body 1 and of the emitter 2 respectively include, for example, a copper oxide layer 1*a* and a hafnium oxide layer 2*a* as a result of their base materials having been exposed to oxygen. FIG. 1B shows a cross-sectional side view of the main body 1 as a cylindrical cavity 1*b* is being formed in a distal end thereof. The cavity 1*b* is formed with the main body 1 disposed inside an oxygen-free environment 200 contained within a chamber 201. The oxygen-free environment may comprise any of a number of gases that are non-reactive with the base materials from which the parts of the electrode are made. Examples of such gases include any inert gas such as argon and nitrogen.

Figure 1C:
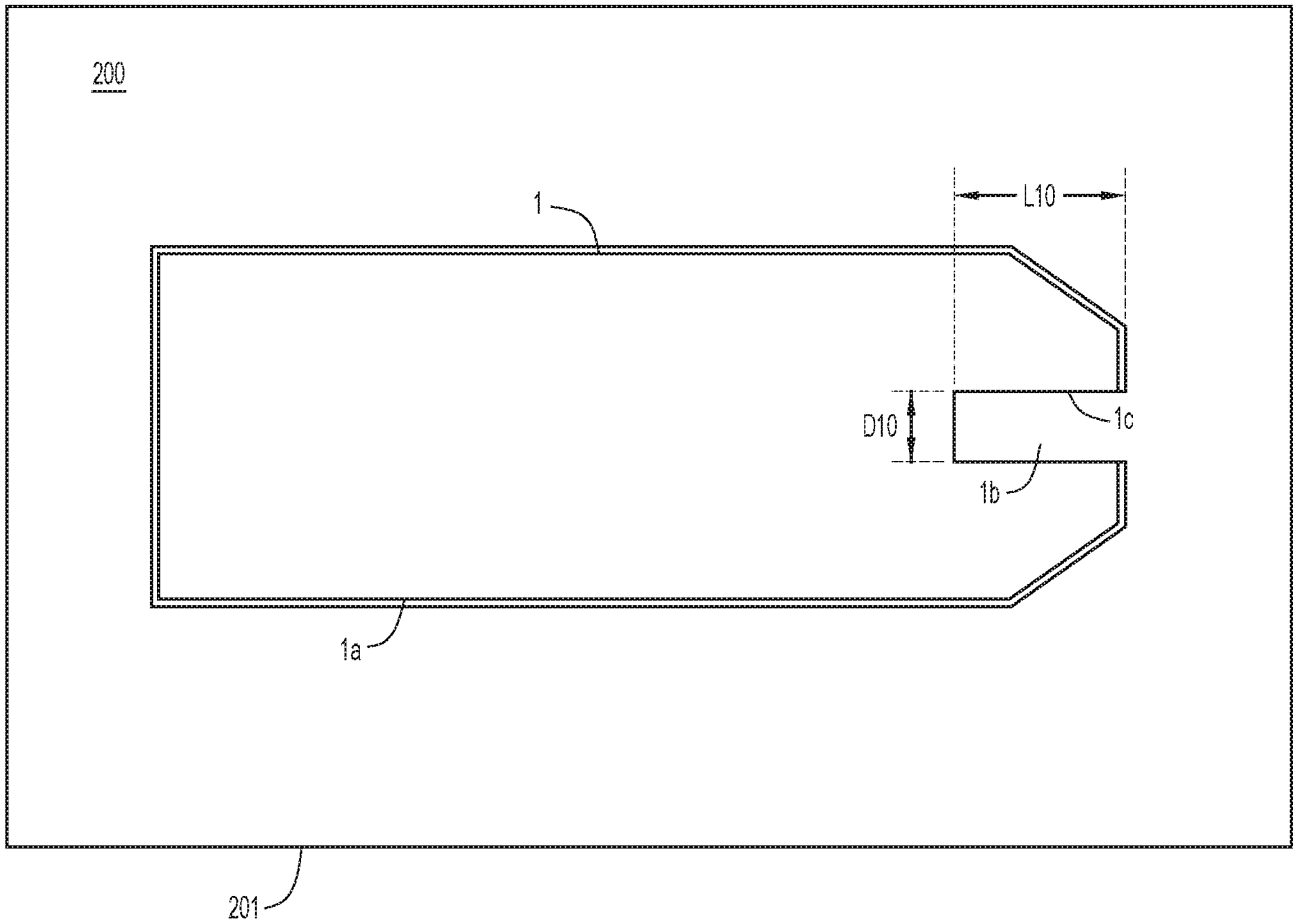
FIG. 1C shows a cross-sectional side view of the main body of FIG. 1B after the cavity has been formed in the distal end thereof.

In the implementation of FIG. 1B, the cavity 1*b* is produced by use of a drill 110, with the cutting being performed by a drill bit 111. Although not shown in the figures, the drill 110 may be attached to a robotic arm, or other automated displacement mechanism, that is capable of displacing the drill's position inside the chamber 201. FIG. 1C shows the main body 1 after completion of the cavity 1*b* with the cavity having a diameter D10 and a length L10. Notably, as a result of the cavity 1*b* being formed inside the oxygen-free environment 200, the inner wall 1*c* of the cavity is oxide-free as shown in FIG. 1C.

Figure 1D:
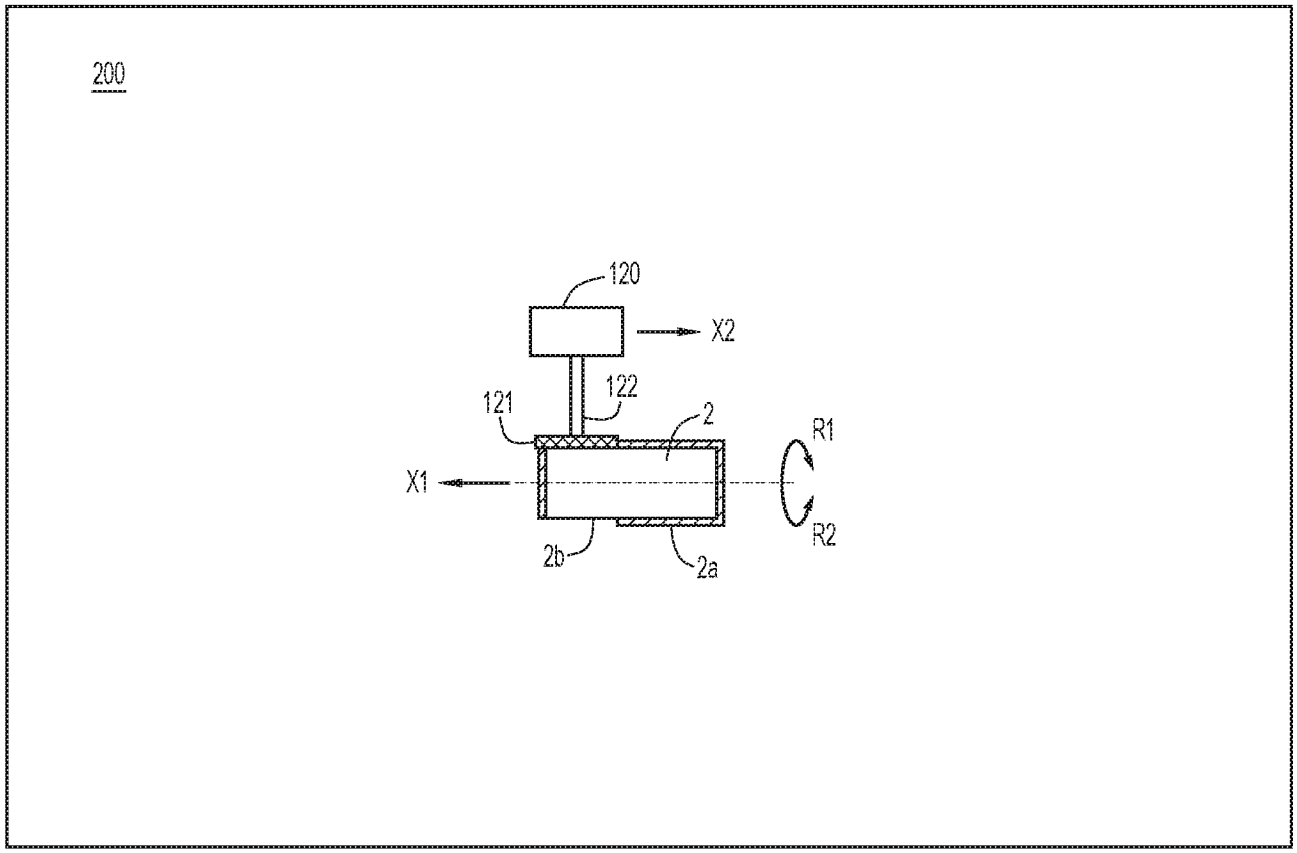
FIG. 1D shows a cross-sectional side view of the emitter of FIG. 1A located in the oxygen-free environment with an oxide layer being removed to produce an oxide-free outer surface along a length of the emitter.

Before, concurrently or after the formation of the cavity 1*b* in the distal end of the main body 1, the emitter 2 is also machined to remove the hafnium oxide layer 2*a* from at least one of its sides that is designated for being electrically and thermally connected with the oxide-free inner surface 1*c* of the main body 1. As shown in FIG. 1D, according to one implementation the removal of the oxide layer 2*a* is achieved through the use of a milling machine that includes a cutter 121 that is connected to a rotating motor 120 through use of a spindle 122. In the implementation of FIG. 1D, the cutter 121 is in the form of a rotating disc that includes one or more cutting elements disposed about is radial perimeter. Although not shown in the figures, the milling machine may be attached to a robotic arm, or other automated displacement mechanism, that is capable of displacing the machine's position inside the chamber 201. According to one implementation, the milling machine is moved along the length of the emitter in the X1 direction as the emitter 2 is rotated in the R1 or R2 direction. According to another implementation, the milling machine is held stationary and the emitter 2 is translated in the X1 direction and rotated in the R1 or R2 direction during the machining process. According to one implementation the milling machine is a lathe.

It is important to note the removal of the oxide layers from the main body 1 and emitter 2 may be accomplished using machining methods other than those disclosed above, such as, for example, grinding. Moreover, the removal of the oxide layers may encompass non-mechanical methods including, but not limited to, one or more chemical etching processes.

Figure 1E:
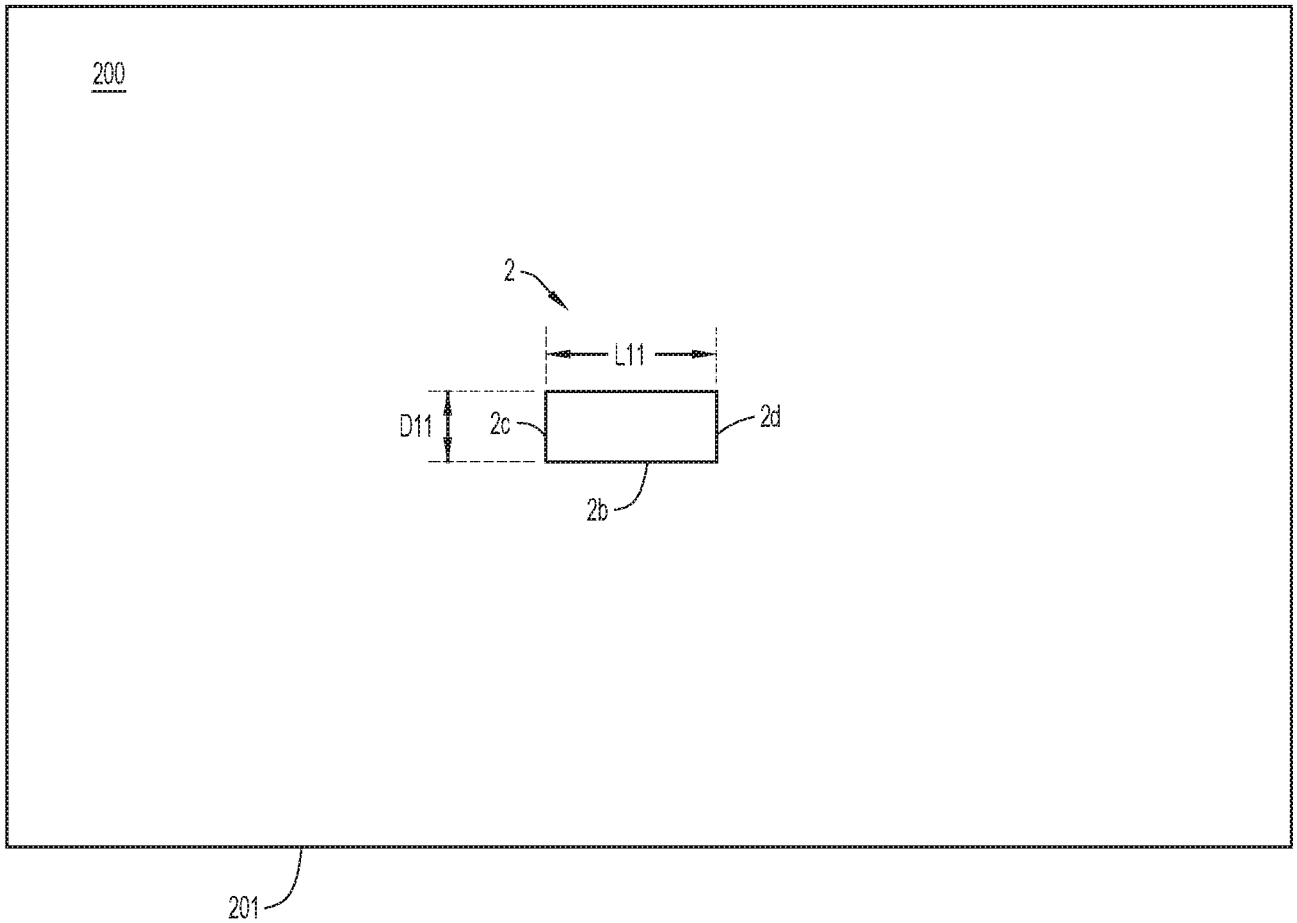
FIG. 1E shows a cross-sectional side view of the emitter of FIG. 1D having an oxide-free outer surface.

As shown in FIG. 1A, according to one implementation the emitter 2 includes an elongated cylindrical surface 2*b*', a proximal end surface 2*c*' and a distal end surface 2*d*' that each encompasses an oxide layer 2*a*. According to one implementation, the oxide layer on each of surfaces 2*b*'-*d*' is removed during the oxide layer removal process as shown in FIG. 1E. However, according to other implementations, only the oxide layer on surfaces 2*b*' and 2*c*' are removed, while according to other implementations only the oxide layer of surface 2*b*' is removed.

Figure 1F:
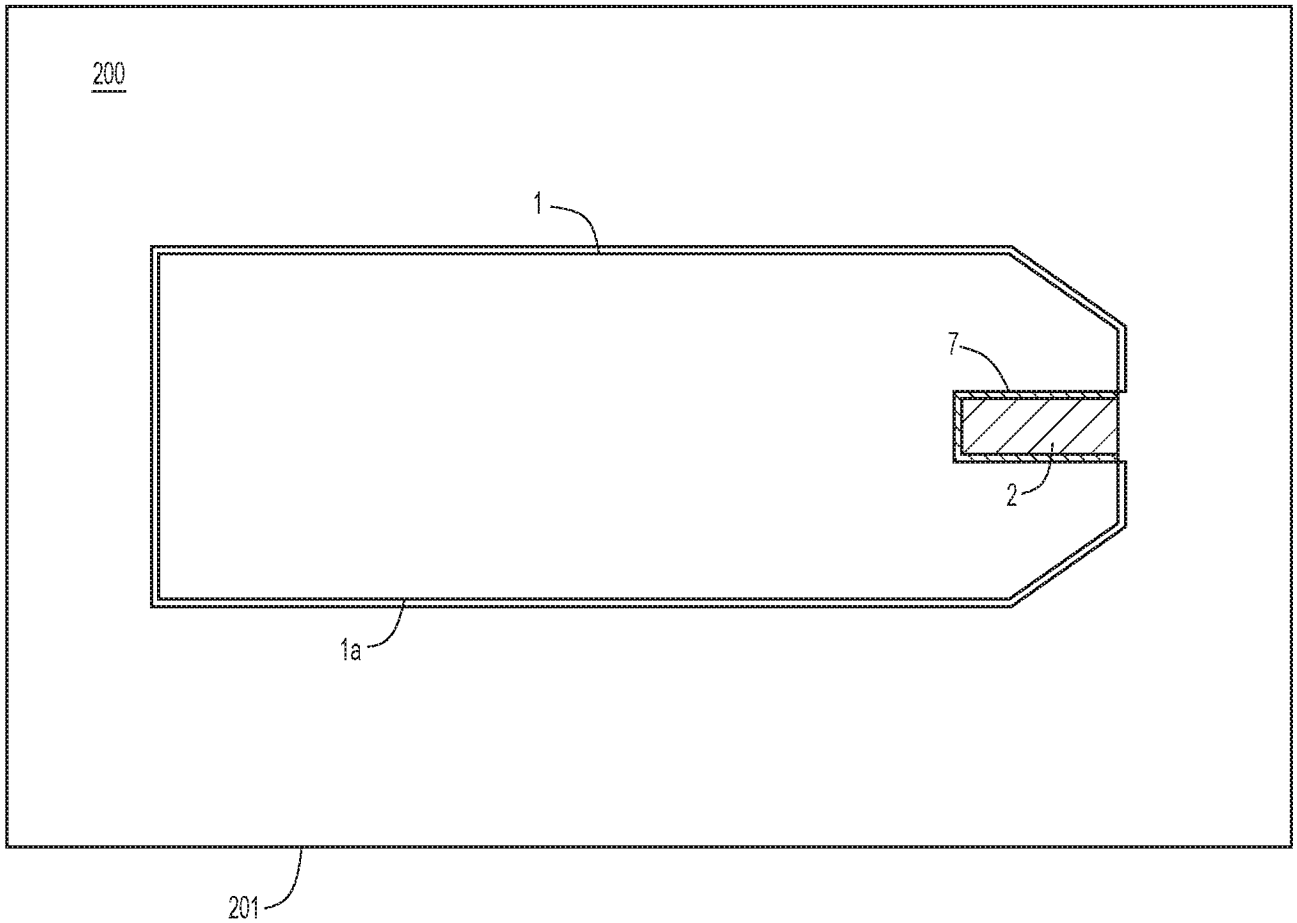
FIG. 1F shows a cross-sectional side view of the main body of FIG. 1C and emitter of FIG. 1E in an assembled state after being assembled together inside the oxygen-free environment.

In the example of FIG. 1E, after the oxide layers 2*a* have been removed, the emitter 2 is endowed with oxide-free surfaces 2*b-d* and has a diameter D11 and length L11. According to some implementations the diameter D11 is less than the diameter D10 of cavity 1*b* and is secured inside the cavity by use of an electrically and thermally conductive solder or adhesive 7 as shown in FIG. 1F. Alternatively, the dimensions of the emitter 2 and cavity 1*b* are produced such that the emitter may be press-fit into the cavity 1*b* to hold it in the main body 1. Regardless of the method by which the emitter 2 is secured to the main body 1, the assembling together of the emitter 2 and main body 1 occurs while they remain inside the oxygen-free environment 200 to prevent a re-oxidation of their exposed surfaces during the assembly process. According to one implementation, as shown in FIG. 1E, the length L11 of the emitter 2 is substantially equal to the length L10 of the cavity 1*b*, but may also be longer or shorter than L10.

As explained above, as a result of the oxide layer removal processes and assembly processes being performed inside an oxygen-free environment, the electrical and thermal conductivity between the main body 1 and emitter 2 is higher than that that would otherwise exist with oxide layers residing on their mating surfaces.

Figure 2:
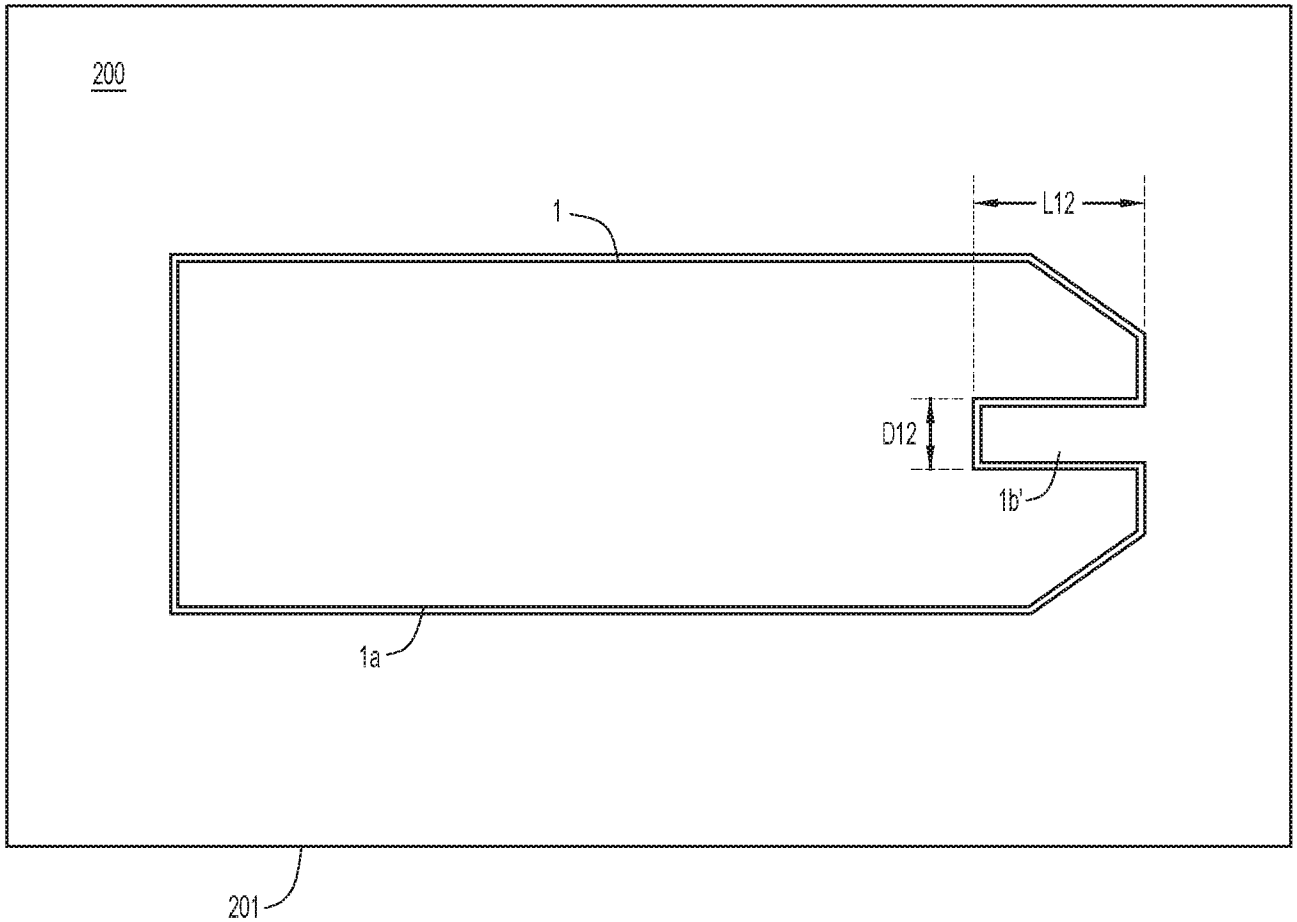
FIG. 2 is a cross-sectional side view of a main body of an electrode according to one implementation prior to being machined inside an oxygen-free embodiment.

In the implementation of FIG. 2, the cavity at the distal end of the main body 1 is partially formed prior to the main body being placed in the oxygen-free environment. According to one implementation, the pre-formed cavity 1*b*' has a diameter D12 and a length L12 that are each respectively less than D11 and L11. The pre-formed cavity 1*b*' has an inner surface covered by an oxide layer 1*a* that, after the main body 1 has been placed in the oxygen-free environment 200, is removed to produce the cavity 1*b* of FIG. 1C. The removal of the oxide layer may be achieved by use of a drilling machine 110 like that described above. An advantage of the implementation of FIG. 2 is that it results in less scrap material being produced inside the oxygen-free environment 200.

As disclosed above, according to some implementations both the main body 1 and emitter 2 are machined to produce mating oxide-free surfaces. However, according to other implementations only one of the main body 1 and emitter 2 is machined to produce an external oxide-free surface. For example, according to one implementation one or more of the external surfaces of the emitter 2 are machined to remove an oxide layer formed thereon while in the oxygen-free environment. Thereafter, while remaining in the oxygen free environment, the emitter 2 is secured inside the cavity 1*b* of the main body 1. The wall defining the cavity 1*b* may or may not comprise an oxide layer.

Figure 3A:
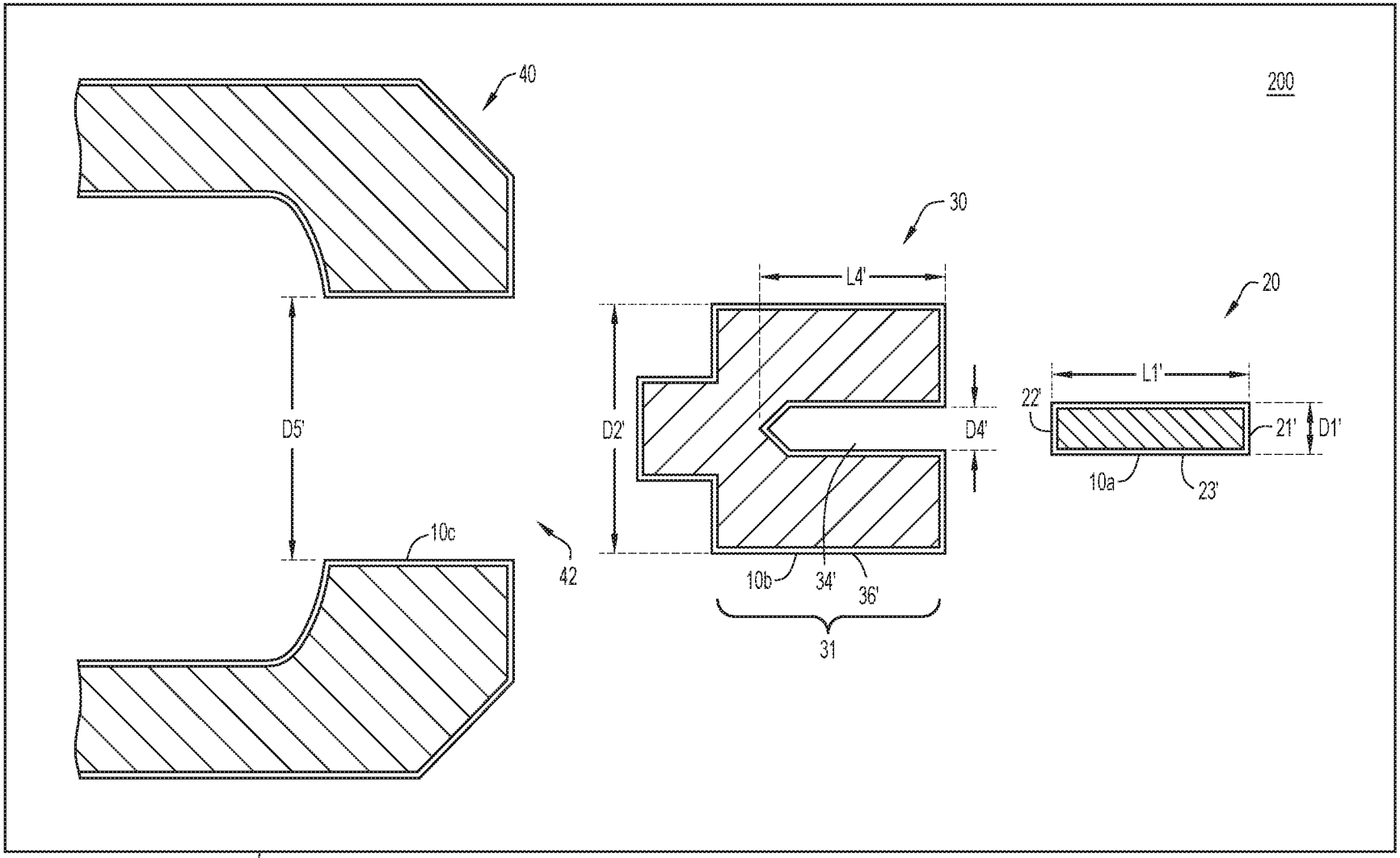
FIG. 3A depicts cross-sectional side views of a main body, emitter holder and emitter of an electrode prior to the components being machined and assembled together inside an oxygen-free environment.
Figure 3B:
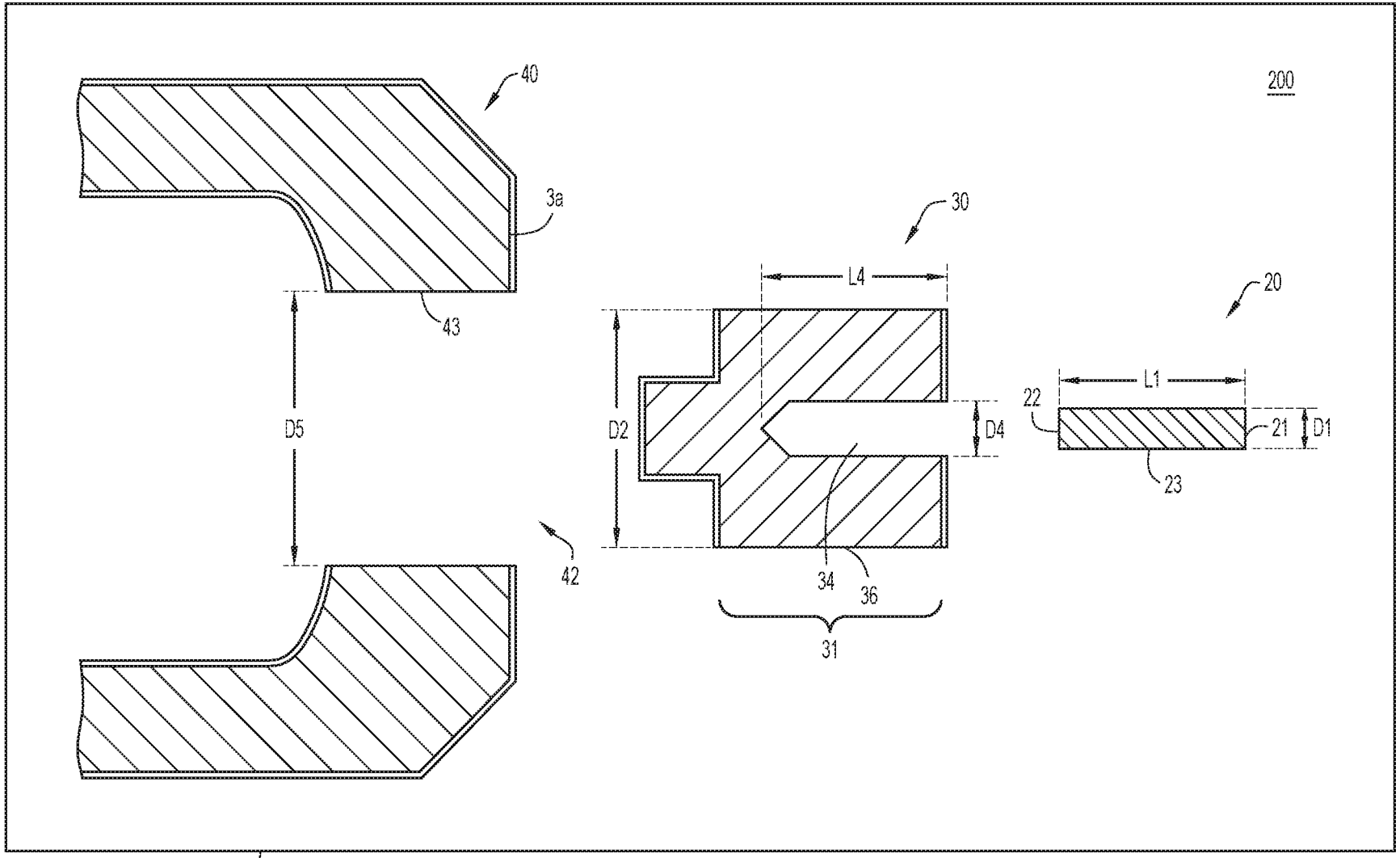
FIG. 3B shows a cross-sectional side view of the main body, emitter holder and emitter of FIG. 3A after having been machined inside the oxygen-free environment.
Figure 3C:
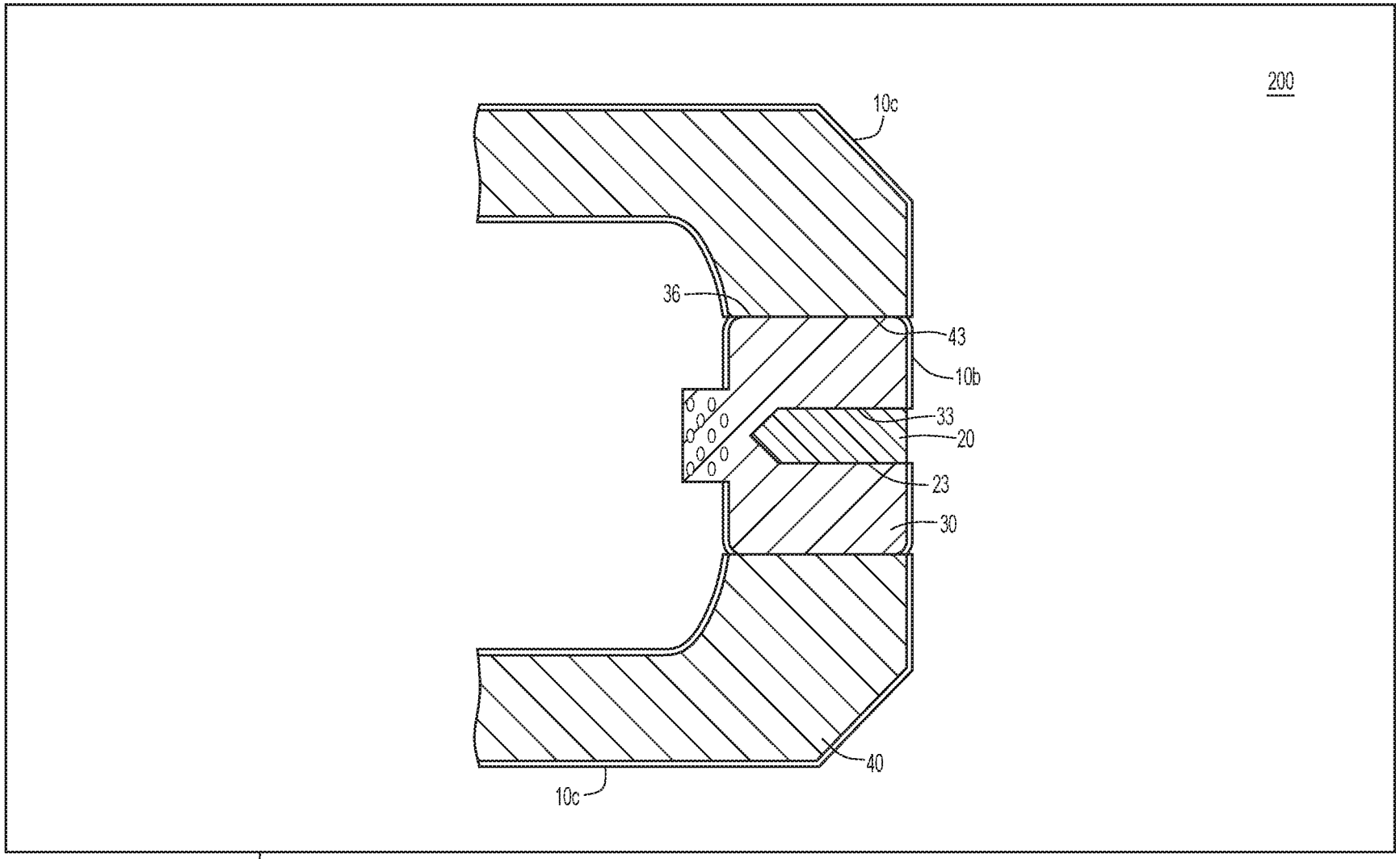
FIG. 3C shows a cross-sectional side view of the main body, emitter holder and emitter of FIG. 3B after having been assembled together inside the oxygen-free environment.

According to some implementations the emitter is not directly coupled to the main body of the electrode, but is instead housed inside an emitter holder that is coupled to the main body. FIGS. 3A-C depict such components with the oxide layer of their mating surfaces first being removed inside an oxygen free environment 200 before they are later assembled together inside the oxygen-free environment.

FIG. 3A illustrates a cross-sectional side view of a distal end section of a main body 40 of an electrode, along with a cross-sectional view of an emitter holder 30 and an emitter 20. As shown in FIG. 3A, each of the emitter 20, emitter holder 30 and main body 40 respectively possesses an outer-most surface that comprises an oxide layer 10*a*, 10*b* and 10*c*. According to some implementations, the main body 40 is made of copper or a copper alloy, the emitter holder 30 is made of silver and the emitter 20 is made of hafnium or a hafnium alloy. As discussed above, each of the components may be made from any of a number of other materials. That is, the disclosed materials are mere examples and are not to be construed as narrowing the scope of the present disclosure. The foremost importance is that the materials are electrically conductive so that current delivered through the main body 40 is adequately transmitted through the emitter holder 30 to the emitter 20 for the purpose of establishing a plasma arc between the emitter 20 and a workpiece. It is also advantageous, but not required, that the materials be good thermal conductors to facilitate the removal of heat away from the emitter 20 into the main body 40. As explained above, each of these attributes impact the useful life of the electrode.

With continued reference to FIG. 3A, the distal end section of the main body 40 includes a through opening 42 and the distal end section of the emitter holder 30 includes a cavity 34'. Before the components are machined, or otherwise processed, to remove selected portions of the oxide layers, the opening 42 has a diameter D5', the cavity 34' has a diameter D4' and length L4', and the emitter has a diameter D1' and a length L1'. Furthermore, the cylindrical body portion 31 of the emitter holder 30 has a diameter D2'.

FIG. 3B shows a cross-sectional side view of the emitter 20, emitter holder 30 and main body 40 inside an oxygen-free environment 200 after selected portions of oxide layers 10*a*, 10*b*, and 10*c* have been respectively removed. Notably, the portions of the oxide layers that are removed are those that reside on the intended mating surfaces of the electrode components. As shown in FIG. 3B, according to one implementation the oxide layer 10*c* is removed from the inner surface of the opening 42 to produce an oxide-free surface 43. As a result of the oxide layer removal, the diameter D5 of the resultant opening 42 is greater than D5'.

Selective portions of the oxide layer 10*b* are also removed from the emitter holder 30 to create an outer circumferential oxide-free outer surface 36 and also an oxide-free inner surface 33 that bounds the cavity 34. After the removal of the oxide layer residing inside cavity 34', the resultant cavity 34 has a diameter D4 that is greater than D4', and according to some implementations a length L4 that is greater than L4'. Furthermore, after the removal of the oxide layer 10*b* along the length of the cylindrical body portion 31 of the emitter holder 30 to produce oxide-free surface 36, the cylindrical body portion 31 has a diameter D2 that is less than D2'.

As also shown in FIG. 3B, the emitter 20 is also processed to remove all or parts of the oxide layer 10*a* so that all resultant exposed surfaces 21, 22 and 23 are oxide-free. According to one implementation, as a result of the oxide layer removal, the resultant diameter D1 and length L1 are respectively less than D1' and L1'.

According to some implementations, each of the opening 42 of the main body 40 and cavity 34 of the emitter holder 30 is produced through the use of a drill bit 111 operated by a drilling machine 110. The removal of the oxide layers on each of the outer circumferential surfaces of the emitter holder 30 and emitter 20 to produce oxide-free outer surfaces 36 and 23 may be accomplished by any of a number of mechanical processes, including, but not limited to milling processes (through use of a lathe, for example) and grinding processes. As noted above, non-mechanical processes, such as chemical etching or thermal cycling (whereby the hafnium is heated below its it melting point causing expansion of the base metal and its oxide layer, the two metals having similar thermal expansion coefficients but significantly different thermal conductivity coefficients causing non-uniform heating and expansion), may also be used to remove the oxide layers. As explained above, each of these processes are carried out inside an oxygen-free environment.

FIG. 3C shows the main body 40, emitter holder 30 and emitter 20 coupled to one another after having been assembled inside the oxygen-free environment 200 wherein the oxide-free surfaces 36 and 43 abut one another and oxide-free surfaces 33 and 23 abut one another to produce an electrical circuit between the main body 40 and the emitter 20 that is free or substantially free of any intervening oxide layers.

A securing together of the emitter 20 with the emitter holder 30 and the securing together of the emitter holder 30 with the main body 40 may be accomplished in a number of ways. For example, according to some implementations the components may be secured together with the use of solder or other electrically conductive bonding agents residing between oxide-free surfaces 36 and 43 and oxide free surfaces 33 and 23. According to other implementations, the components are fused together at the interface of the oxide-free surfaces.

As disclosed above, according to some implementations each of the emitter 20, emitter holder 30 is machined to produce mating oxide-free surfaces. However, according to other implementations fewer than all or only one of the emitter 20, emitter holder 30 and main body 40 is machined inside an oxygen-free environment to produce one or more external oxide-free surfaces that is/are configured to be electrically coupled to an adjoining one of the other components. Thereafter, while remaining in the oxygen free environment, the emitter 20, emitter holder 30 and main body 40 are assembled together in the oxygen free-environment.

Figure 4:
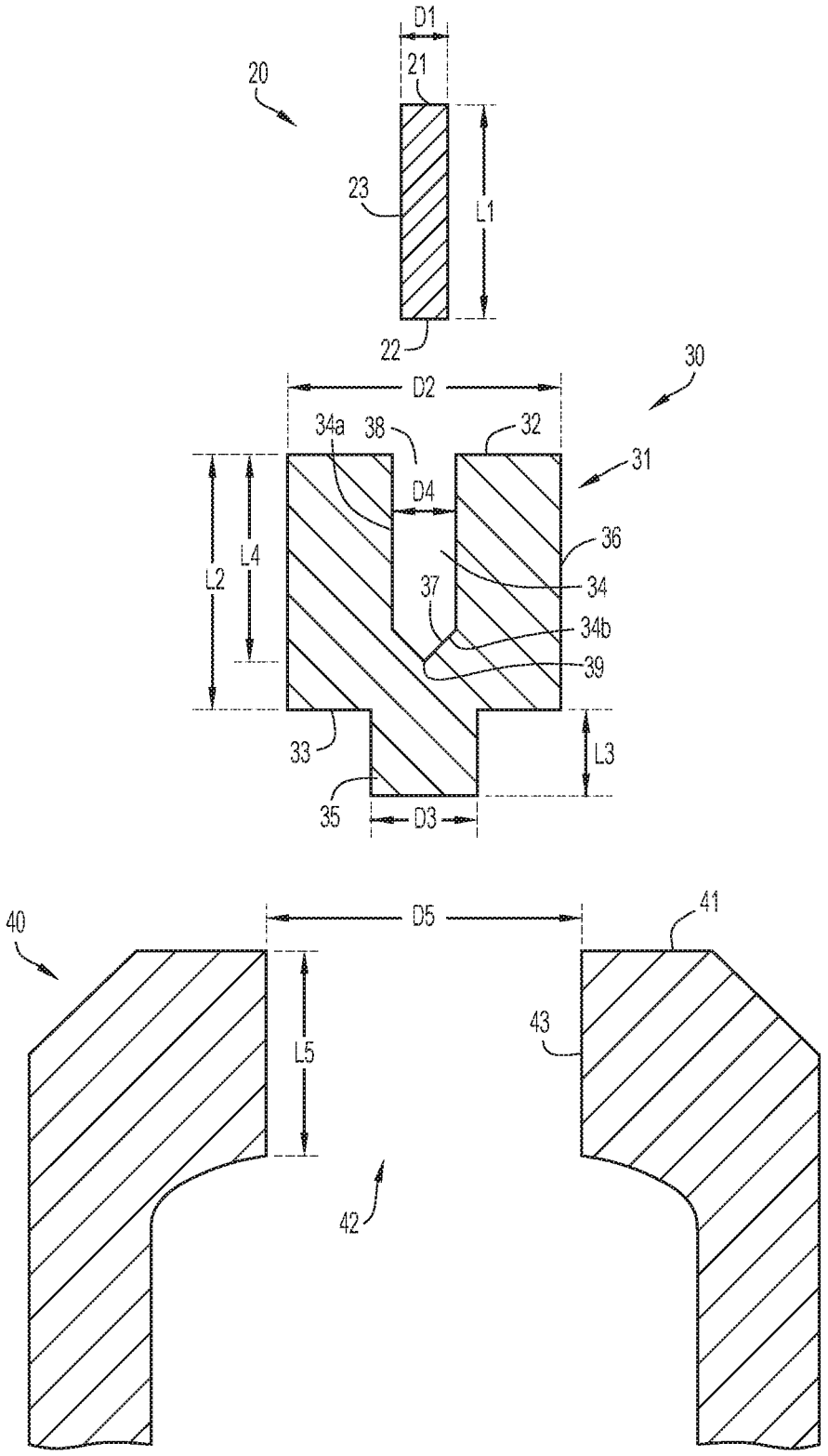
FIG. 4 is a cross-sectional side view of an emitter, emitter holder and main body of an electrode according to one implementation.
Figure 5:
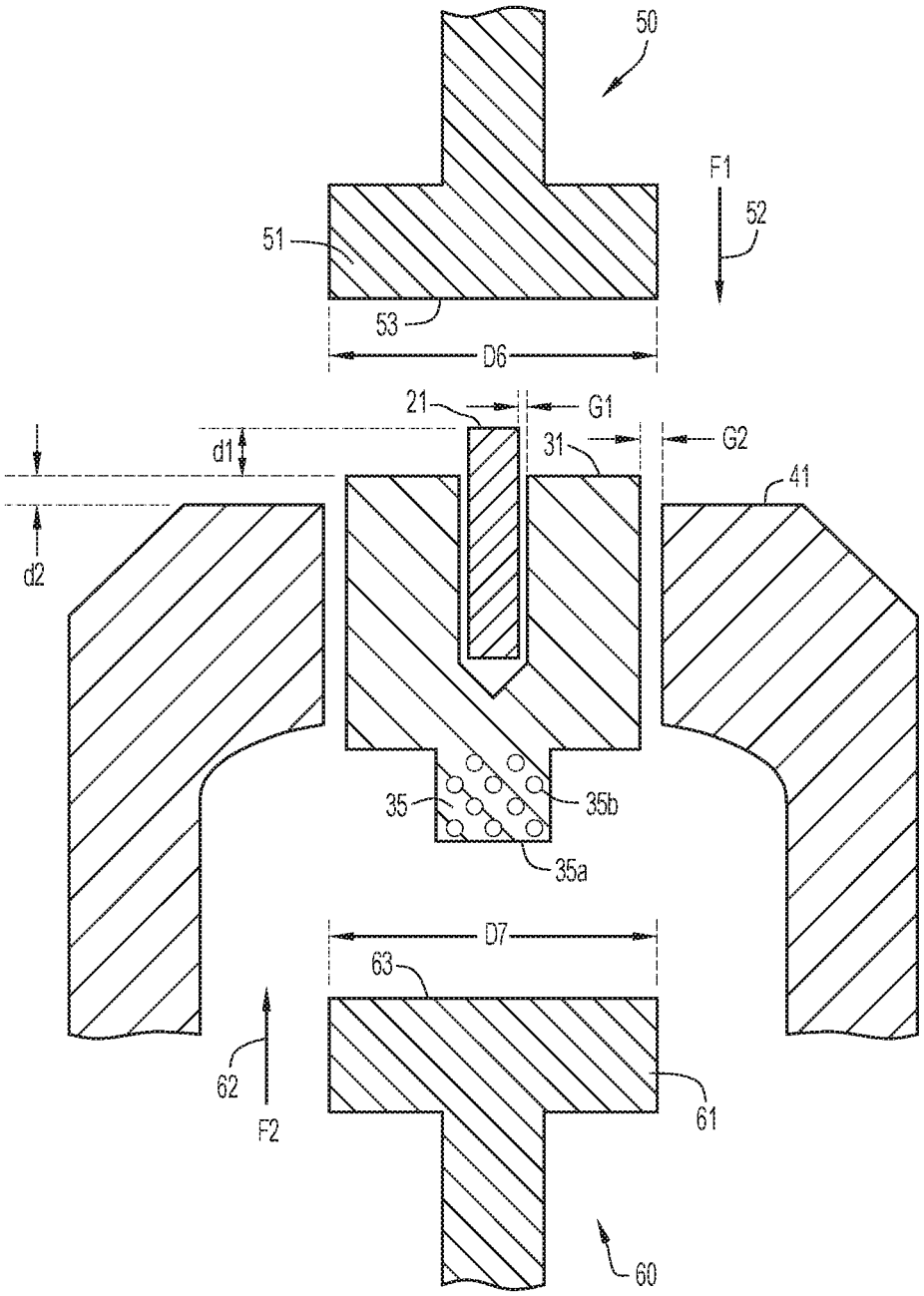
FIG. 5 is a cross-section side view of an arrangement of the emitter, emitter holder and main body of FIG. 4 in a pre-assembled state just prior to forces being applied to the parts to secure them together.
Figure 6:
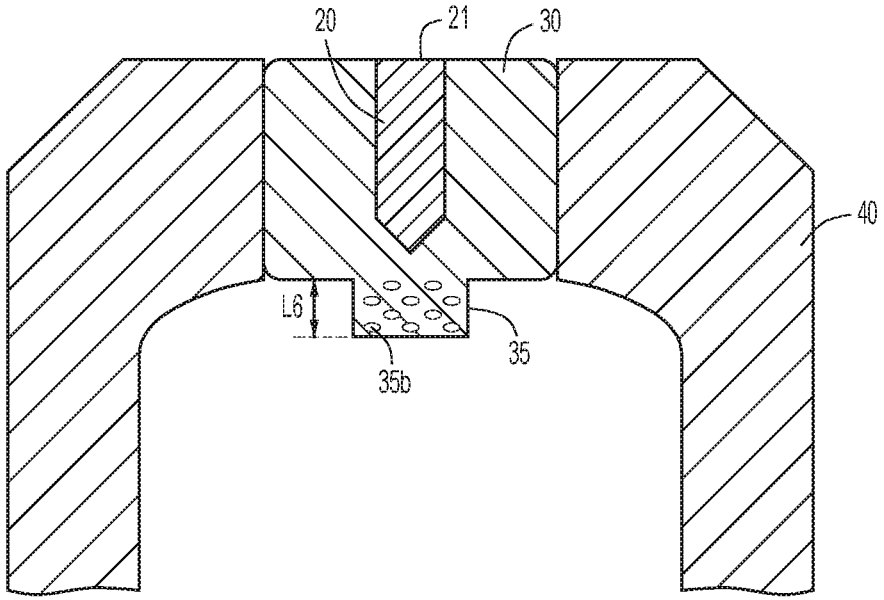
FIG. 6 is a cross-section side view of the emitter, emitter holder and main body of FIG. 5 according to one implementation with the emitter secured inside the emitter holder and the emitter holder secured inside the main body.

FIGS. 4-6 illustrate another method of joining the emitter 20, emitter holder 30 and main body 40 to form the plasma torch electrode. The method includes securing the emitter 20 inside the cavity 34 of the emitter holder 30 while at the same time securing the emitter holder 30 inside the through opening 42 located in the distal end of the main body 40.

As discussed above, according to some implementations, the emitter 20 is a cylindrical body that in its ready to assemble state includes an oxide-free distal end 21, an oxide-free proximal end 22 and an oxide-free cylindrical external wall 23. In its ready to assemble state, as shown in FIG. 4, the emitter 20 has a diameter D1 and a length L1. The emitter holder 30 includes the internal cavity 34 that has an open distal end 38 and a closed proximal end 39. According to some implementations, a distal end section 34*a* of the cavity is cylindrical, and a proximal end section 34*b* of the cavity is cone-shaped formed by a converging inner wall 37. According to some implementations, the emitter holder 30 includes a proximally protruding part 35 that is meant to reside inside a cavity 44 of the tubular body 40 before and after the electrode is assembled, the purpose of which is discussed below. The emitter holder 30 includes a cylindrical body 31 in which the cavity 34 resides. The cylindrical body 31 includes a distal end 32, proximal end 33 and the oxide-free external cylindrical wall 36. When the emitter holder 30 is in the ready to assemble state, the cylindrical body portion 31 has an external diameter D2 and a length L2 and the proximally protruding part 35 has a diameter D3 and a length L3. The internal cavity 34 of the emitter holder 30, in turn, has a diameter D4 greater than the diameter D1 of the emitter 20 and a length L4 less than the length L1 of the emitter 20 as best shown in FIG. 5.

With continued reference to FIG. 4, the distal end section of the main body 40 includes a through opening 42 bound by the oxide-free cylindrical wall 43 located at the distal end of the main body. In the main body's ready to assemble state, as shown in FIGS. 4 and 5, the through opening 42 communicates with an inner chamber 44 of the tubular body. According to some implementations, the inner chamber 44 is a cooling chamber through which a coolant passes when the electrode is in operation. As best seen in FIG. 4, the diameter D5 of the through opening 42 is greater than the diameter D2 of the cylindrical body portion 31 of the emitter holder 30. The length L5 of the through opening 42 may be greater than, equal to, or less than the length L2 of the cylindrical body portion 31 of the emitter 30. In the implementation of FIG. 2, the cylindrical body portion 31 of the emitter 30 has a length that is greater than the length of the through opening 42.

FIG. 5 shows an arrangement of the emitter 20, emitter holder 30 and tubular part 40 in a pre-assembled state just prior to forces F1 and F2 being applied to the parts to secure them together with the emitter 20 being centered inside the cavity 34 of the emitter holder 30 and with the cylindrical body portion 31 of the emitter holder 30 centered inside the through opening 42 of the tubular body 40. According to some implementations, in the pre-assembled state of FIG. 5, the emitter 20 and internal cavity 34 of the emitter holder 30 are dimensioned such that a gap G1 of 0.0005 inches to 0.001 inches exist between the outer cylindrical wall 23 of the emitter and the internal wall 33 of the cavity 34, and such that the distal end 21 of the emitter 20 is located distal to the distal end 31 of the emitter holder by a distance d1 of 0.015 inches to 0.100 inches.

According to some implementations, in the pre-assembled state the cylindrical portion 31 of the emitter holder 30 and the through opening 42 of the tubular body 40 are dimensioned such that a gap G2 of 0.0005 inches to 0.001 inches exist between the outer cylindrical wall 34 of the emitter holder and the internal wall 43 of the through opening 42, and such that the distal end 31 of the emitter holder 30 is located distal to the distal end 41 of the tubular body by a distance d2 of 0.0001 inches to 0.02 inches.

Figure 7:
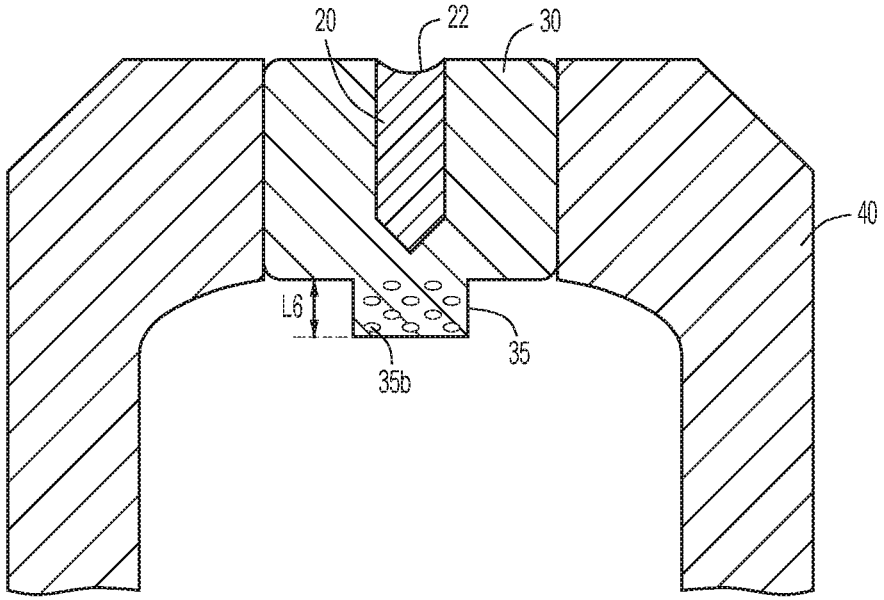
FIG. 7 is a cross-section side view of the emitter, emitter holder and tubular body according to another implementation with the emitter secured inside the emitter holder and the emitter holder secured inside the main body.

With the emitter 20, emitter holder 30 and tubular body 40 arranged in their pre-assembled states as shown in FIG. 5, proximal and distal directed forces F1 and F2 are applied to secure the parts together by use of tools 50 and 60. Tool 50 includes a head 51 with a proximal face 53 that is configured to press against the distal end 21 of the emitter 20 when the tool 50 is moved in the proximal direction as shown by arrow 52. Tool 60 includes a head 61 with a distal facing surface 63 that is configured to press against the proximal end 35*a* of the emitter holder 30 when the tool is moved in the distal direction as shown by arrow 62. A salient feature of this method of assembling the electrode is the simultaneous securing of the emitter 20 to the emitter holder 30 and the emitter holder 30 to the tubular body 40 by simultaneously applying force F1 to the distal end 21 of the emitter 20 and a force F2 to the proximal end 35*a* of the emitter holder 30. As shown in FIG. 6, the simultaneous application of the proximal and distal directed forces F1 and F2 causes a deformation of each of the emitter 20 and the emitter holder 30 so that the oxide-free external wall 23 of the emitter 20 bulges radially outward to forcefully contact the oxide-free internal wall 33 of the internal cavity 34 of the emitter holder 30, and so that the oxide-free external wall 36 of the cylindrical body portion 31 of the emitter holder 30 bulges radially outward to forcefully contact the oxide-free inner wall 43 of the through opening 42 of the tubular body 40. The bulging of the emitter 20 inside the cavity 34 of the emitter holder 30 permanently fixes the emitter to the emitter holder, and the bulging of the emitter holder 30 inside the through opening 42 of the tubular body 40 permanently fixes the emitter holder to the tubular body in a manner that produces a leak-tight seal and an electrical connection between the emitter holder and the tubular body. FIGS. 6 and 7 show the electrode in an assembled state according to different implementations.

According to some implementations, the heads 51 and 61 of tools 50 and 60 are cylindrical in form and have diameters D6 and D7 that are each less than the diameter D5 of the through opening 42 extending through the distal end section of the tubular body 40. According to some implementations, the first and second heads 51 and 61 have different diameters. According to some implementations, the second head 61 has a diameter that is less than the diameter of the first head 51. It is important to note that the geometric form of heads 51 and 61 need not be cylindrical, but in any event, according to some implementations the heads 51 and 61 are sized not to contact the tubular body 40 during the application of proximal and distal directed forces F1 and F2.

According to some implementations, the distance d2 and the load applied by forces F1 and F2 are selected such that distal end 31 of the emitter holder 30 is flush with or located distal to the distal end 41 of the tubular body by a distance less than d2 at the end of the application of forces F1 and F2. Even in the event of the distal end 31 of the emitter holder 30 being made flush with the distal end 41 of the tubular body 40 while forces F1 and F2 are being applied, after the forces F1 and F2 are removed, the distal end 31 of the emitter holder 30 may still thereafter distally protrude out of the through opening 42 of the tubular body 40 by a distance less than d2 due to the elasticity of the material from which the emitter holder is made.

Figure 8:
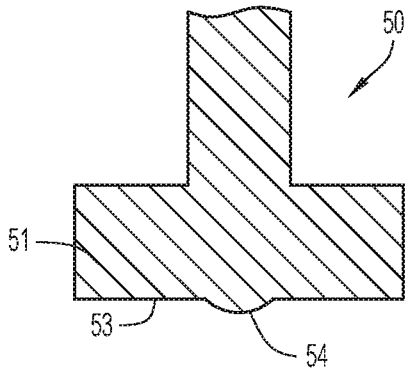
FIG. 8 is a side view of a force applicator comprising a curved protrusion for forming a concave indentation in the distal surface of the emitter of FIG. 7.

According to some implementations, the distance d1 and the load applied by forces F1 and F2 are selected such that the distal end 21 of the emitter 20 is flush with or located distal to the distal end 31 of the emitter holder 31 by a distance less than d1 at the end of the application of forces F1 and F2, as shown in FIG. 5. In such cases, the proximal facing surface 53 of the first tool 50 may be planar, as shown in FIG. 5. However, according to other implementations the distal end 21 of the emitter 20 is made to include a concave indentation 22 as shown in FIG. 7 when the forces F1 and F2 are being applied. According to some implementations, the concave indentation has a maximum depth of between 0.047 inches to 0.075 inches and is made by a curved protrusion 54 of the proximal facing surface 53 of the first tool 50 like that shown in FIG. 8.

As discussed above, according to some implementations the emitter holder 30 is equipped with a proximally protruding part 35. As shown in FIGS. 6 and 7, in the electrode's assembled state the proximally protruding part 35 resides inside a cavity/chamber 44 of the tubular body 40. In some instances, as noted above, the cavity may be a cooling chamber through which a coolant is passed to cool the emitter holder 31 when the electrode is operated. In such instances, the protruding part 35 provides addition surface area over which the coolant passes to increase the heat removal capacity of the cooling system. To further increase the heat removal capacity, as shown in FIGS. 5-7, the external surfaces of the protruding part 35 may be ribbed, dimpled, etc. to further increase the external surface area of the protruding part. FIGS. 5-7 show dimples 35*b*.

The proximally protruding part 35 of the emitter holder 30, alternatively or in conjunction with its heat removal function, may simply act as a spacer that prevents any portion of the tool 60 from making contact with the tubular body 40 when the distal directed force F2 is being applied to the emitter holder 30.

According to some implementations, the proximally protruding part 35 is made to be shortened during the electrode assembling process as shown in FIGS. 6 and 7 as compared to FIG. 5, with the length of the protruding part transitioning from an initial length L3 to a final length L6 during the assembling process.

According to some implementations, after the electrode is in its assembled state, like that shown in FIGS. 6 and 7, a pressurized fluid is delivered into the cavity 44 of the tubular body 40 to determine the integrity of the leak-tight seal. The pressurized fluid may be, for example, air or water.

Figure 9:
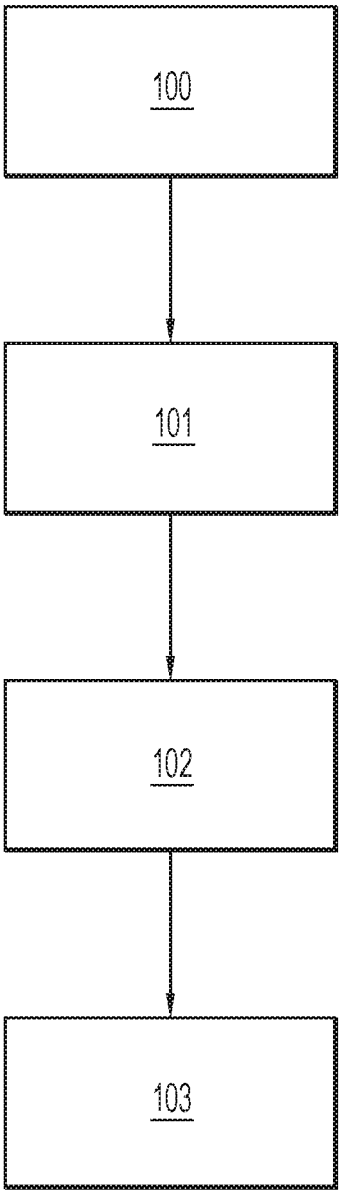
FIG. 9 is a flow diagram of a method of assembling together the parts of a plasma torch electrode according to one implementation.

FIG. 9 is a flow diagram of a method of assembling together the parts of a plasma torch electrode according to one implementation. Each of the steps occurs inside an oxygen-free environment. The method includes in step 100 the obtaining of an emitter, an emitter holder and a main body, like those of FIGS. 3B and 4, that are to be assembled together to form the electrode. In step 101 the emitter is placed inside a cavity of the emitter holder and the emitter holder is placed inside a through opening of the main body. As a result of their geometric configurations, a distal end of portion of the emitter protrudes distally out of the emitter cavity and a distal end portion of the emitter holder protrudes distally out of the through opening of the main body. At step 102, the emitter is secured inside the cavity of the emitter holder simultaneous with the emitter holder being secured inside the distal end section of the main body. The securing together is accomplished by simultaneously applying a proximal directed force to the emitter and a distal directed force to the emitter holder to induce a bulging of the emitter inside the emitter holder to cause an external surface of the emitter to forcefully contact an internal surface of the emitter holder, and to induce a bulging of the emitter holder inside the distal end of the main body to cause an external surface of the emitter holder to forcefully contact an internal surface of the main body to produce a leak-tight seal and an electrical connection between the emitter holder and the tubular body. In step 103, a pressurized fluid is optionally introduced into the cavity of the main body for the purpose of determining the integrity of the leak-tight seal established between the emitter holder and main body in step 102.

The particular implementations shown and described herein are illustrative examples of the invention and are not intended to otherwise limit the scope of the invention in any way. For the sake of brevity, conventional aspects of the components may not be described in detail.

What is claimed is:

1. A method of making and assembling together components of a plasma torch electrode, the components including a main body made of a first electrically conductive material and an emitter made of a second electrically conductive material, the method comprising:

in an oxygen-free environment, removing a first oxide layer from the emitter by machining an outer surface of the emitter to produce an oxide-free outer surface;

in the oxygen-free environment, removing a second oxide layer from the main body by machining an opening in a distal end of the main body, the opening being bounded by an oxide-free inner surface of the main body after the machining; and in the oxygen-free environment, securing the emitter inside the opening of the main body such that the oxide-free outer surface of the emitter is secured to or joined to the oxide-free inner surface of the main body.

2. The method according to claim 1, wherein the machining of the outer surface of the emitter includes a milling process or grinding process to remove the first oxide layer, and the machining of the opening in the distal end of the main body to remove the second oxide layer including a drilling process.

3. The method according to claim 1, wherein the oxide-free outer surface of the emitter is secured to the oxide-free inner surface of the main body by use of a solder or braze.

4. The method according to claim 1, wherein the oxide-free outer surface of the emitter is secured to the oxide-free inner surface of the main body by fusing the first and second electrically conductive materials.

5. The method according to claim 1, wherein the emitter is secured inside the opening of the main body by being press-fit into the opening.

6. The method according to claim 1, wherein the oxygen-free environment is a chamber filled with an inert gas.

7. The method according to claim 1, wherein the second electrically conductive material is selected from the group consisting of hafnium, a hafnium alloy, zirconium, a zirconium alloy, tungsten and a tungsten alloy.

8. The method according to claim 7, wherein the first electrically conductive material is copper or a copper alloy.

9. A method of making and assembling together components of a plasma torch electrode, the components including a main body made of a first electrically conductive material, an emitter made of a second electrically conductive material, an emitter holder made of a third electrically conductive material, the method comprising:

in an oxygen-free environment, removing a first oxide layer from the emitter by machining an outer surface of the emitter to produce a first oxide-free outer surface;

in the oxygen-free environment, machining an opening into the emitter holder that is configured to receive the emitter and removing a second oxide layer from the emitter holder by machining an outer surface of the emitter holder to produce a second oxide-free outer surface, the opening of the emitter holder being bound by an oxide-free inner surface of the emitter holder;

in the oxygen-free environment, removing a third oxide layer from the main body by machining an opening in a distal end of the main body that is configured to receive the emitter holder, the opening in the distal end of the main body being bound by an oxide-free inner surface of the main body; and in the oxygen-free environment, securing the emitter inside the opening of the emitter holder such that the first oxide-free outer surface is secured to the oxide-free inner surface of the emitter holder, and securing the emitter holder inside the opening of the main body such that the second oxide-free outer surface is secured to the oxide-free inner surface of the main body.

10. The method according to claim 9, wherein the emitter is secured inside the opening of the emitter holder while at the same time the emitter holder is secured inside the opening of the main body.

11. The method according to claim 9, wherein the securing of the emitter inside the opening of the emitter holder and the securing of the emitter holder inside the opening of the main body is accomplished by simultaneously applying a proximal directed force to the emitter and a distal directed force to the emitter holder to induce a bulging of the emitter inside the opening of the emitter holder to cause the first oxide-free outer surface of the emitter to forcefully contact the oxide-free inner surface of the emitter holder, and to induce a bulging of the emitter holder inside the opening of the main body to cause the second oxide-free outer surface of the emitter holder to forcefully contact the oxide-free inner surface of the main body.

12. The method according to claim 11, wherein each of the emitter and emitter holder shorten during the application of the proximal and distal directed forces.

13. The method according to claim 11, wherein the emitter holder comprises a cylindrical portion that includes the second oxide-free outer surface, and during the application of the proximal and distal directed forces the cylindrical portion bulges to cause the second oxide-free outer surfaces to forcefully contact the oxide-free inner surface of the main body, the oxide-free inner surface of the main body defining a distal through opening of the main body.

14. The method according to claim 9, wherein the securing of the emitter inside the opening of the emitter holder and the securing of the emitter holder inside the opening of the main body is accomplished by simultaneously applying a proximal directed force to the emitter and a distal directed force to the emitter holder to induce a bulging of the emitter inside the opening of the emitter holder to cause the first oxide-free outer surface of the emitter to forcefully contact the oxide-free inner surface of the emitter holder, and to induce a bulging of the emitter holder inside the opening of the main body to cause the second oxide-free outer surface of the emitter holder to forcefully contact the oxide-free inner surface of the main body to produce a leak-tight seal and an electrical connection between the emitter holder and the main body, the securing together being accomplished without soldering or fusing the emitter holder to the main body and without soldering or fusing the emitter to the emitter holder.

15. The method according to claim 9, wherein the machining of the outer surface of the emitter includes a milling process, and the machining of the opening in the distal end of the main body includes a drilling process.

16. The method according to claim 9, wherein the oxide-free outer surface of the emitter is secured to the oxide-free inner surface of the main body by use of a solder or braze.

17. The method according to claim 9, wherein the oxygen-free environment is a chamber filled with an inert gas.

18. The method according to claim 9, wherein the second electrically conductive material is selected from the group consisting of hafnium, a hafnium alloy, zirconium, a zirconium alloy, tungsten and a tungsten alloy.

19. The method according to claim 18, wherein the first electrically conductive material is copper or a copper alloy.

* * * * *